United States Patent [19]

Brothers

[11] 4,380,092

[45] Apr. 19, 1983

[54] ACCESSORY FOR USING STEEL WOOL OR OTHER ABRADING MATERIALS

[76] Inventor: Woodrow W. Brothers, 220 N. Elmhurst Ave., Mt. Prospect, Ill. 60056

[21] Appl. No.: 238,223

[22] Filed: Feb. 26, 1981

[51] Int. Cl.[3] ..... A47L 13/34

[52] U.S. Cl. ..... 15/209 C; 15/97 R; 15/230.17; 15/257 R; 51/358; 428/100

[58] Field of Search ..... 15/159 A, 209 C, 209 D, 15/230.17, 257 R; 51/358; 24/204, DIG. 11; 248/205 A; 428/100

[56] References Cited

U.S. PATENT DOCUMENTS

| | | | |
|---|---|---|---|
| 2,500,840 | 3/1950 | Lyons et al. | 15/209 D X |
| 2,951,286 | 9/1960 | Mann | 15/236 NO X |
| 3,302,232 | 2/1967 | Wasiloff et al. | 15/230.17 |
| 3,395,416 | 8/1968 | Hughes | 15/228 |
| 4,071,983 | 2/1978 | Thielen | 15/209 D X |
| 4,273,130 | 6/1981 | Simpson | 24/204 X |

FOREIGN PATENT DOCUMENTS

| | | | |
|---|---|---|---|
| 806890 | 2/1969 | Canada | 51/358 |

*Primary Examiner*—Chris K. Moore
*Attorney, Agent, or Firm*—Charles F. Lind

[57] ABSTRACT

This disclosure teaches an accessory that can be used to hold steel wool for powered use thereof driven by a power tool. The disclosed accessory utilizes a mat formed of the hook section of the hook and loop fastener, such as is marketed under the Velcro or Scotchmate tradenames. It has been found that steel wool can be releaseably held fast against and to the hooked mat. The accessory is sized and shaped so as to allow it to be secured onto the output element of a conventional power tool, such as onto the platen of a vibrating sander. This thereby allows the power tool to be used for powered steel wooling, thereby increasing the usefulness of the tool while reducing the drudgery of steel wooling. Other looped or woven forms of abrading material, such as polishing rags, can be releaseably adhered to the hooked mat for powered buffing with the powered sander.

5 Claims, 4 Drawing Figures

ACCESSORY FOR USING STEEL WOOL OR OTHER ABRADING MATERIALS

BACKGROUND OF THE INVENTION

Many forms of abrasive materials are available for stripping out or buffing surfaces to a smooth finish and/or high gloss. These materials include sandpapers of various weights and grades, wire brushes, emery cloths or the like, and steel wool. To use any of these abrasive materials, the abrasive material is moved relative to the article or to the surface to be finished. For many do it yourself consumer type buffing projects, there is nothing better than old elbow grease in manually creating or causing this relative buffing movement.

However, many power tool devices are available for holding certain of these abrasives for allowing powered applications of them. Thus, an electric drill can be used with its rotating output to power rotate for example a rotary wire brush or a sanding pad or buffer. These items, the rotary wire brush, sanding pad or buffer are available as accessory items for just such purposes. Also, a belt sander is a common power tool, using a special endless sanding belt that is trained over a pair of spaced rollers and is rotated by one of the rollers to move unidirectionally against the article or surface to be finished. A further variation of a sander is the vibrating sander, where a platen is power oscilated back and forth, in a straight line or a tight orbital path, and a piece of sandpaper is held to the platen to be moved then relative to the article or surface to be finished.

It is noted, however, that there are few power tool devices suitable for powered manipulation of steel wool. The characteristics of smoothness or abrasiveness in steel wool, for example as compared to a sandpaper, is most significant and consequently the substitution then of sandpaper for steel wool can not be readily made. Steel wool can be used effectively on wood, metal, glass or ceramic, and even plastic or composition materials.

Steel wool itself is a composite mass of a plurality of finely and randomly woven or stranded wires, typically of steel, where each wire strand is of such fine cross section as to offer only minor resistance against bending and where a great multitude of such strands are grouped together in a rather loose or pillowy mass or pad. This pillowy nature makes it somewhat difficult to chuck or hold the steel wool relative to most power tool devices. Nonetheless the random crossing of the pillowy strands create a very beneficial abrading action against the surface where it is desired to remove impurities from or roughness from the surface.

Thus steel wool can be used in stripping a surface of paint, varnish or the like, and the stripping action requires random back and forth movement of the steel wool relative to the surface. Further, a metallic surface of brass, copper, chrome or the like frequently can be buffed up with steel wool to remove rust, tarnish or the like from the surface. However, steel wooling in the main has been handled manually and is very tiring; which is not totally satisfactory in this advanced age of the machine and other work saving devices.

SUMMARY OF THE INVENTION

This invention relates to an accessory for a conventional power tool for allowing the tool to be used for powered steel wooling. The invention teaches means for fixedly but removably securing a steel wool pad or mass to the output of the power tool to allow then the steel wool to be used under power.

The invention is most practically used with a powered sander having its output in the form of a moving or vibrating platen. The invention more specifically provides a steel wool holding component that is adapted to be secured in place against the platen, the component being in the form of a mat of the hook half of a Velcro fastener. The pad of steel wool itself is then adapted to be pressed against the Velcro mat so as to be adhered thereto in a fixed nonmovable fashion, whereby operation of the sander thereby provides for powered steel wooling as desired.

DETAILED DESCRIPTION OF THE INVENTION

Figure 1:
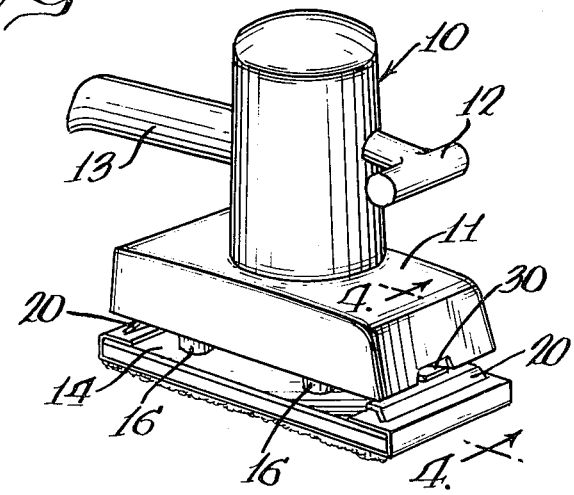
FIG. 1 is a perspective view of a vibrating sander for which this invention has great utility, showing in use thereon a preferred embodiment of this invention for holding a pad of steel wool for powered steel wooling with the sander.

In FIG. 1, a vibrating sander 10 is illustrated, having a case 11 or frame which includes handles 12 and 13 that can be manually grasped by an operator to allow manipulation of the sander. A platen 14 is supported relative to the frame 11 by four spaced resilient posts (only two at 16 being shown). The platen 14 can thus be moved parallel to itself back and forth and laterally of the frame 11 as the posts 16 are flexed, and a motor (not shown) housed within the frame 11 acts through an eccentric drive (not shown) to rapidly vibrate the platen 14 relative to the frame 11.

Various types of sanders 10 are available and any type can be used with this invention. Thus, one type provides only a straight line path of platen oscillation, "in-line" or front to rear of the sander; while another type provides only a circular or orbital path of platen oscillation; while yet another can be adjusted to have either of these platen movements and sometimes even in varying combinations.

Figure 4:
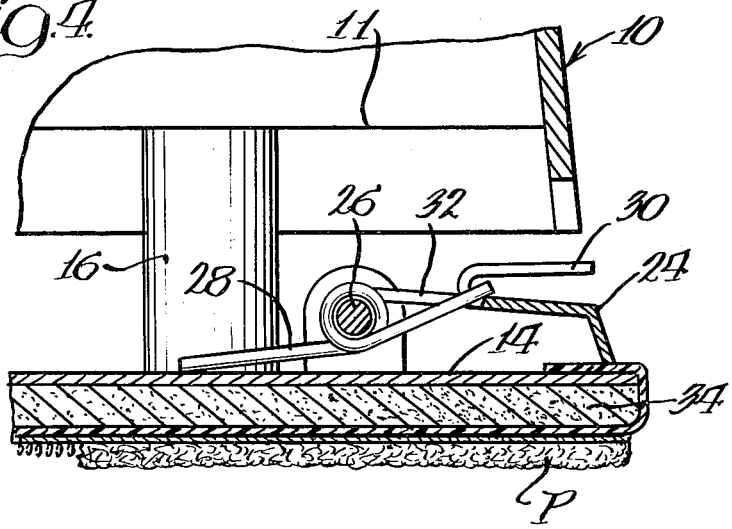
FIG. 4 is a sectional view, as taken generally from lines 4—4 in FIG. 1, showing conventional manner of securing the steel wool holding component or pad to the sander.

Each conventional vibrating sander 10 further includes means 20 to hold a sheet of sandpaper to the platen. In the sander illustrated, these holding means 20 are located on the backside of the platen 14 at its forward and rearward ends. Each holding means 20 includes a clip 24 (see FIG. 4) pivoted about a pin 26 and biased by a coil spring 28 so that the clip is moved against the backside of the platen 14. There further can be formed from the clip 24 an offset tab 30 to allow a screwdriver or like tool (not shown) to be positioned in the opening 32 formed adjacent the tab in order to easily open or close the clip against the bias of the spring 28 for allowing easy securement or release of the work abrading element relative to the vibrating platen. Typically further there is a pad 34 of fiber, foam or other resilient material that is bonded or otherwise secured to the outer face of the platen 14 to serve as a backing for the sandpaper or other abrading element.

In ordinary use of the sander 10, a sheet of sandpaper (not shown) sized larger than the platen 14 is butted against the pad 34 and has its ends folded around the opposite ends of the platen to be positioned under and held by the clips 24.

Figure 3:
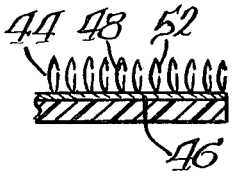
FIG. 3 is a sectional view, as taken generally from lines 3—3 in FIG. 2, showing the looped or hook like configuration of the holding component or mat.
Figure 2:
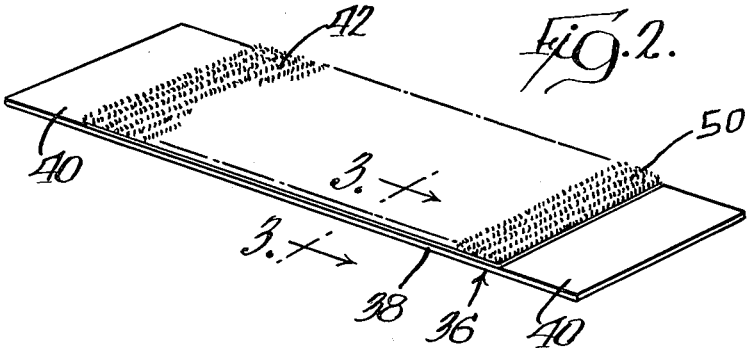
FIG. 2 is a perspective view of the steel wool holding component or mat formed according to the subject invention.

Referring now more specifically to FIGS. 2 and 3, the invention will now be disclosed. An improved steel wool holding element 36 is illustrated, and includes a backup sheet 38 of such size that it can traverse the platen and pad and yet having sufficient end sections 40 that can be fitted around the end edges of the platen and held beneath the clips 24. Secured to the intermediate section only of the backup sheet 38 is a mat 42 of a rigid or stiff hooked material. By way of example, the mat 42 can be similar to the hook half of a Velcro fastener, which is a product of Velcro U.S.A. Inc., a subsidiary of Textron Corporation of New York, N.Y. The standard Velcro fastener consists of two mating pieces, one having a looped face and the other having a hooked face, and these two faces when pressed together adhere to one another, as is well known. The hook faced pieces (see FIG. 3) has many individual elements 44 each of a firm or stiff nature that is bent upon itself and is secured at its ends to a backsheet 46. These elements thereby project away from the backsheet and each in a sense defines an eyelet 48. In a typical Velcro mat, there might be well in excess of several hundred individual eyelets and the eyelets basically are aligned in a systematic pattern such as along spaced parallel rows 50.

The illustrated "hook" section of Velcro has one leg 52 of each eyelet cut to define a "J-type" hook, and this configuration might be considered standard as it is most common. The configuration where each eyelet is left closed is known as an "uncut" Velcro hook; while the configuration where both legs of the eyelet are cut is known as a "stubble" hook. The "J-type" hook as illustrated is preferred with this invention, although the other configurations work in certain instances.

Again now referring to FIG. 4, it is readily apparent that the improved abrading holding element 36 is located relative to the platen of the vibrating sander 10 so that the hook configurations of the Velcro mat 44 project away from the platen over the whole breadth or at least over a large part of the platen. To use the sander for steel wooling, a pad P of steel wool is positioned against the mat 42 and becomes adhered or fixed thereto. The adhesion is temporary in that the steel wool can be pulled away from the Velcro mat; but however when it is in place, the steel wool is fixedly held relative to the platen and can be used with the sander for powered steel wooling.

It is well known that steel wool comes in varying forms, one form being a small pillow type pad which in turn is packaged in a larger box or container having many other similar pads. Alternatively, the steel wool can come in a large mass from which smaller pieces are individually torn away with care by the user to develop a pad of the size required for a particular application. The particular manner of achieving the steel wool pad is immaterial, but it is only required that sufficient steel wool be adhered to the steel wool holding mat 42 to preclude contact of the mat itself directly against the surface to be abraded.

It will be understood that the steel wool becomes adhered within the plurality of hooks formed on the mat 42, and in the most part can be removed merely by pulling the steel wool pad away from the mat. However, even in the event that all of the steel wool is not released from the hooked mat 42 but in fact some of the steel wool remains adhered to the mat, fresh steel wool can be adhered to the platen 14 because this steel wool will adhere to the mat and/or to the old steel wool already held in place on the mat.

The backup sheet 38 and the mat 42, when secured together, act as a unitary piece. Nonetheless, the sheet 38 should be of sufficient durability and strength to allow the steel wool to be held rigidly relative to the platen at least at the surface of the platen and to allow solid securement of its ends 40 by the clips 24. A thin sheet of plastic material, backed by fibers or the like, such as sold by Uniroyal Inc. under the trade name Naugahyde, has proven to be very suitable. A woven mat of canvas, nylon or other durable material would also be suitable. Moreover, the backing sheet 38 and the Velcro mat 42 can be bonded together by means of adhesives marketed by Velcro U.S.A. Inc., or by others; can be sewed by suitable durable threads, typically of nylon; or by a combination of bonding and sewing.

While mention has been made to Velcro U.S.A. Inc. as a supplier of the desired holding mat 36 of a hook and loop fastener, others including the 3M Company with its product Scotchmate provide equivalent and suitable hook section holding mats. Also, while primary attention has been directed to the holding element 36 as a means for holding steel wool, it also has proven very effective for holding certain other types of abrading material. Thus, woven buffing or polishing cloths, T-shirts, or even pieces of a blanket can be held by the holding element 36 for powered polishing with the vibrating sander.

What is claimed is:

1. For use with a power sander having a platen that can be oscillated under power, an improved accessory comprising the combination of a sheet of flexible material adapted to extend the entire length of the accessory and moreover be removably secured to the platen, said sheet of flexible material being sized larger than the exposed face of the platen so as to provide an intermediate section that can overlie the platen face and end sections that can be wrapped around the platen ends and be gripped thereat operable to secure the sheet of flexible material relative to the platen, and a mat area sized approximately the same as the platen face and secured flush against the sheet of flexible material at the intermediate section thereof, the mat area being in the form of the hook portion only of a Velcro-type hook and loop fastener, whereby when the flexible sheet is secured to the platen said mat area is virtually coextensive of and entirely backed by the platen and is rigidly held relative to the platen and the hooks of the Velcro-type hook fastener are exposed and projected away from the platen, whereby an abrading element such as a pad of steel wool can be pressed against and adhered to the mat area operable thereby to allow use of the power sander for powered steel wooling.

2. The combination according to claim 1, wherein the sheet of flexible material is in the form of a durable fiber backed vinyl, such as Naugahyde, wherein the mat area is in the form of a separate piece of the hook part of the Velcro-type hook and loop fastener, and wherein the hook part piece is secured to the sheet of flexible material to become a unitary part therewith.

3. The combination according to claim 2, wherein the hook part piece and sheet of flexible material are secured together by adhesive.

4. The combination according to claim 2, wherein the hook part piece and sheet of flexible material are secured together by stitching.

5. The combination according to claim 2, wherein the hook part piece and sheet of flexible material are secured together by a combination of adhesive and stitching.

* * * * *